US005685121A

United States Patent [19]

DeFrancesco et al.

[11] Patent Number: 5,685,121

[45] Date of Patent: Nov. 11, 1997

[54] METAL STUD

[76] Inventors: Frank DeFrancesco, 14690 Mount Hope Road, Bolton, Ontario, Canada, L7E 5R8; Joseph Domenic Palumbo, 23 Highbury Street, Bolton, Ontario, Canada, L7E 5Y7

[21] Appl. No.: 602,281

[22] Filed: Feb. 16, 1996

[51] Int. Cl.[6] ..... E04C 3/30

[52] U.S. Cl. ..... 52/731.9; 52/732.2; 52/241; 52/731.3; 52/731.5

[58] Field of Search ..... 52/238.1, 241, 52/242, 243, 290, 481.1, 630, 664, 720.1, 731.1, 731.5, 751.3, 732.3, 732.2, 737.1, 737.6, 739.1, 731.3, 731.4, 731.7, 731.8, 731.9, 733.2, 731.2

[56] References Cited

U.S. PATENT DOCUMENTS

| | | | |
|---|---|---|---|
| 3,831,333 | 8/1974 | Nelsson et al. | 52/737.6 X |
| 4,397,127 | 8/1983 | Mieyal | 52/241 |
| 4,918,899 | 4/1990 | Karytinos | 52/241 X |
| 5,127,760 | 7/1992 | Brady | 52/241 X |
| 5,129,204 | 7/1992 | Palumbo | 52/720 |
| 5,218,803 | 6/1993 | Wright | 52/664 X |
| 5,325,651 | 7/1994 | Meyer et al. | 52/243 X |

FOREIGN PATENT DOCUMENTS

| | | | |
|---|---|---|---|
| 2855604 | 4/1980 | Germany | 52/731.9 |

*Primary Examiner*—Carl D. Friedman
*Assistant Examiner*—Yvonne Horton-Richardson
*Attorney, Agent, or Firm*—Shoemaker and Mattare, Ltd.

[57] ABSTRACT

An insert is provided for a metal stud, the insert being sized and configured to be snugly but slidably received within the stud. The insert further includes an elongate slot in each side wall, located so as to allow fasteners to secure a sheet of covering material to the stud without interfering with the ability of the insert to move longitudinally with respect to the stud, in the event of overloading, earthquake, etc.

8 Claims, 3 Drawing Sheets

METAL STUD

This invention relates to metal studs of the kind used in drywall construction. More particularly, this invention has to do with an improvement in the standard metal stud involving an added component, such that, if the stud is called upon to change its length, such as may occur during an earthquake, the stud will do so rather than buckling.

BACKGROUND OF THIS INVENTION

Metal studs are now very widely used for interior drywall construction and for exterior construction, particularly for apartment and commercial buildings. With the simple cold-rolled configuration of the standard metal stud, in which the cross-section is uniform throughout its length, problems can arise if an axial load is placed on the stud, as could well happen during an earthquake. As another example, if a stud were installed so that its bottom end abutted a concrete floor and its top end touched either another floor or a roof structure which could deflect downwardly under heavy load, the resulting longitudinal compressive stress that would arise in the stud could easily cause the stud to buckle laterally at an intermediate location, thus distorting the wall and requiring it to be replaced.

Thus, there has been a need for a metal stud configured in such a way that it can yield to absorb longitudinal forces.

One response to this need is the construction shown in U.S. Pat. No. 5,129,204, issued to one of us on Jul. 14, 1992. This prior patent shows the provision of an accordionated or "bellows" region in the stud itself, allowing the stud to deflect under heavy axial load, either by shortening the distance between its ends (rather than by buckling in the middle region of the stud), or by lenthening the distance between its ends. While the prior U.S. Pat. No. 5,129,204 presents a workable solution to the problem, there is still room for improvement.

GENERAL DESCRIPTION OF THIS INVENTION

In view of the above discussion, it is the aim of an aspect of this invention to provide an insert for use with a metal stud, the insert being telescopingly associated with the stud in such a way that the overall stud length can shrink or expand under heavy axial load, without danger of buckling.

More particularly, this invention provides, for use with a metal stud of the type having a main wall with two opposed parallel edges, two similar parallel side walls extending in the same direction from said edges integral with said main wall, each side wall having, remote from the main wall, an integral flange extending toward the opposed side wall:

an insert which is configured and sized to be snugly but slidably received within said metal stud at one end thereof, and including parallel lateral walls intended to lie inwardly along said side walls of the metal stud, said lateral walls having recess means located so as to allow fasteners to secure a sheet of covering material to the respective side wall without interfering with the ability of the insert to move longitudinally with respect to the metal stud.

This invention further provides, in combination:

a) a metal stud of the type having: a main wall with two opposed parallel edges, and two similar parallel side walls extending in the same direction from said edges integral with said main wall, each side wall having, remote from the main wall, an integral flange extending toward the opposed side wall, and b) an insert snugly but slidably received within said metal stud at one end thereof, and including parallel lateral walls lying inwardly along said side walls of the metal stud, said lateral walls having recess means located so as to allow fasteners to secure a sheet of covering material to the respective side wall without interfering with the ability of the insert to move longitudinally with respect to the metal stud.

GENERAL DESCRIPTION OF THE DRAWINGS

One embodiment of this invention is illustrated in the accompanying drawings, in which like numerals denote like parts throughout the several views, and in which.

DETAILED DESCRIPTION OF THE DRAWINGS

Figure 1:
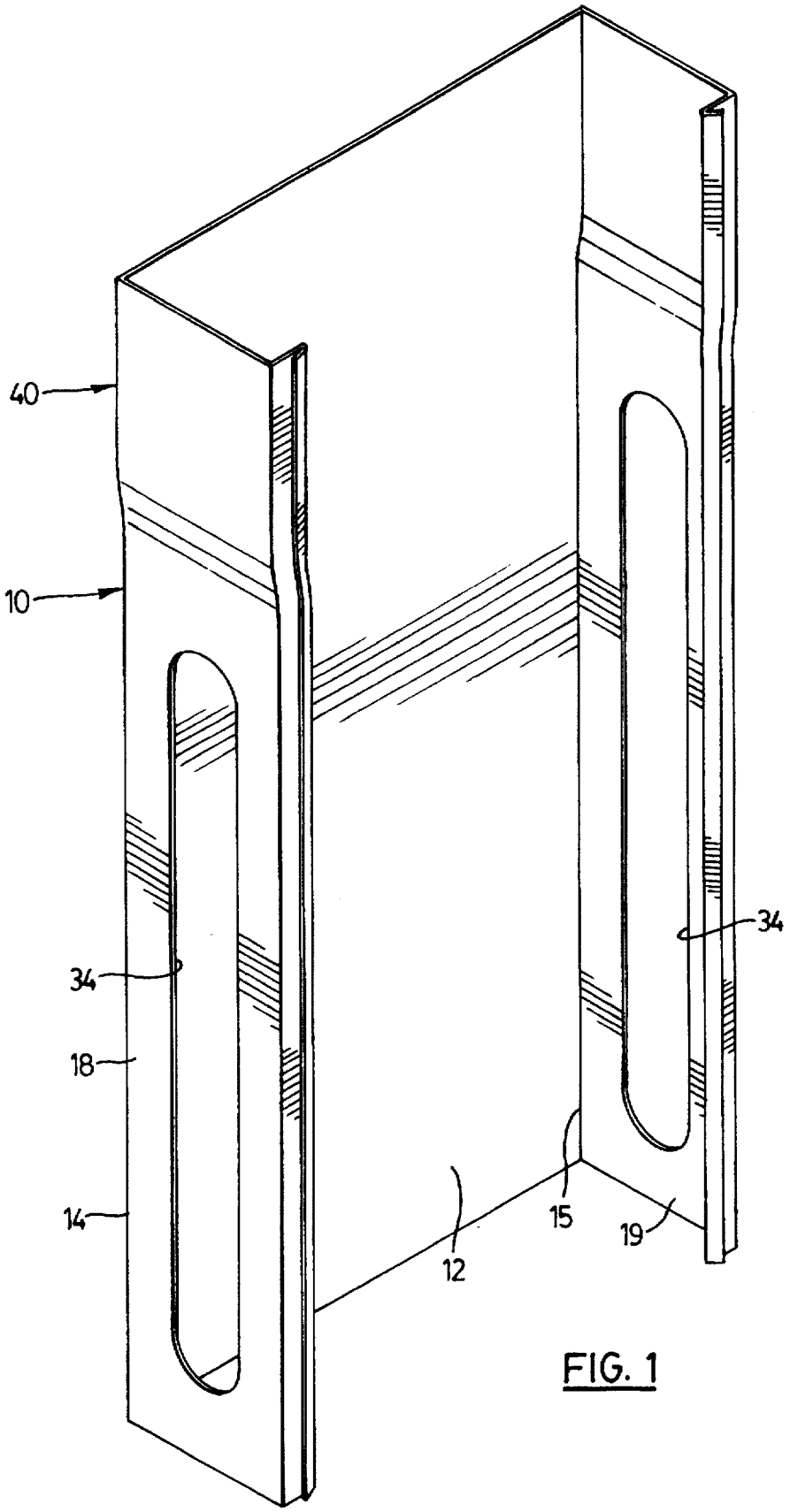
FIG. 1 is a perspective view of an insert for use with a metal stud, according to the present invention.

Attention is first directed to FIG. 1, which shows an insert 10 which includes a main wall 12 having parallel side edges 14 and 15, from which two parallel lateral walls 18 and 19 extend in the same direction. Before completing the description of the insert 10 of FIG. 1, attention is directed to FIG. 2, for a description of the main stud 20. As can be seen, the stud 20 has a flat, upstanding main wall 22 with two opposed parallel edges 24 and 26, and two similar parallel side walls 28 and 30 extending in the same direction from the edges 24, 26 respectively, and integral with the main wall. Each side wall 28, 30 has, remote from the main wall 22, and integral flange 32 extending toward the opposed side wall.

Figure 3:
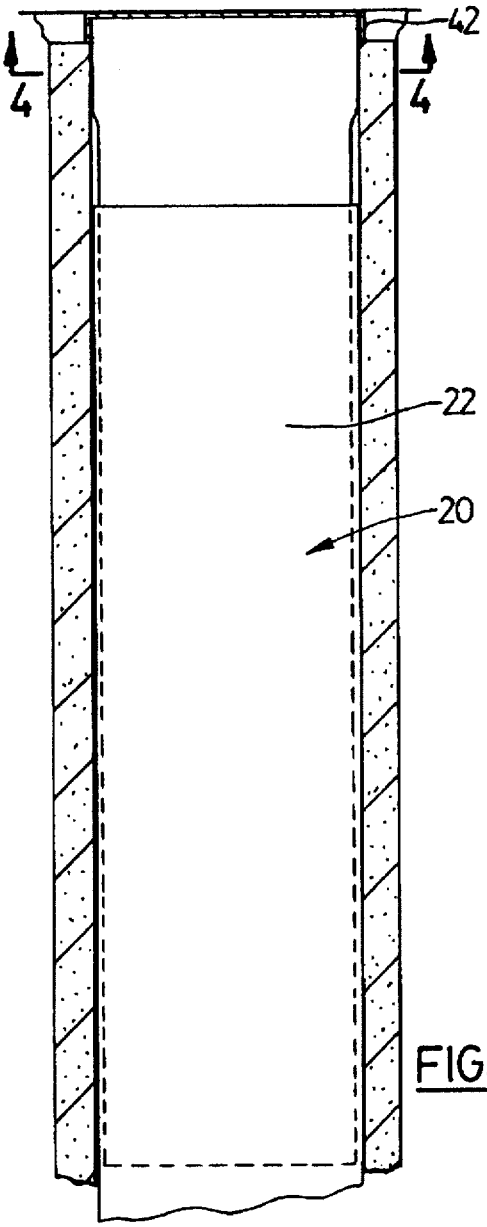
FIG. 3 is a vertical cross-sectional view through a wall supported by the improved stud of this invention, showing the stud in elevation, and the sheeting material in section.
Figure 4:
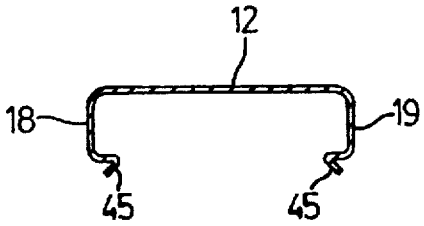
FIG. 4 is a cross-sectional view taken at the line 4—4 in FIG. 3, but showing only the insert.
Figure 2:
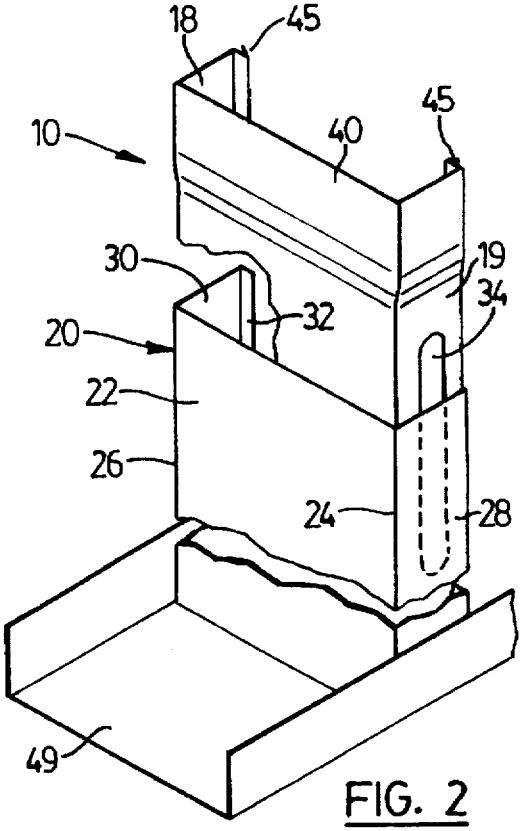
FIG. 2 is a perspective view of a metal stud with the insert of FIG. 1 in a position of use.
Figure 5:
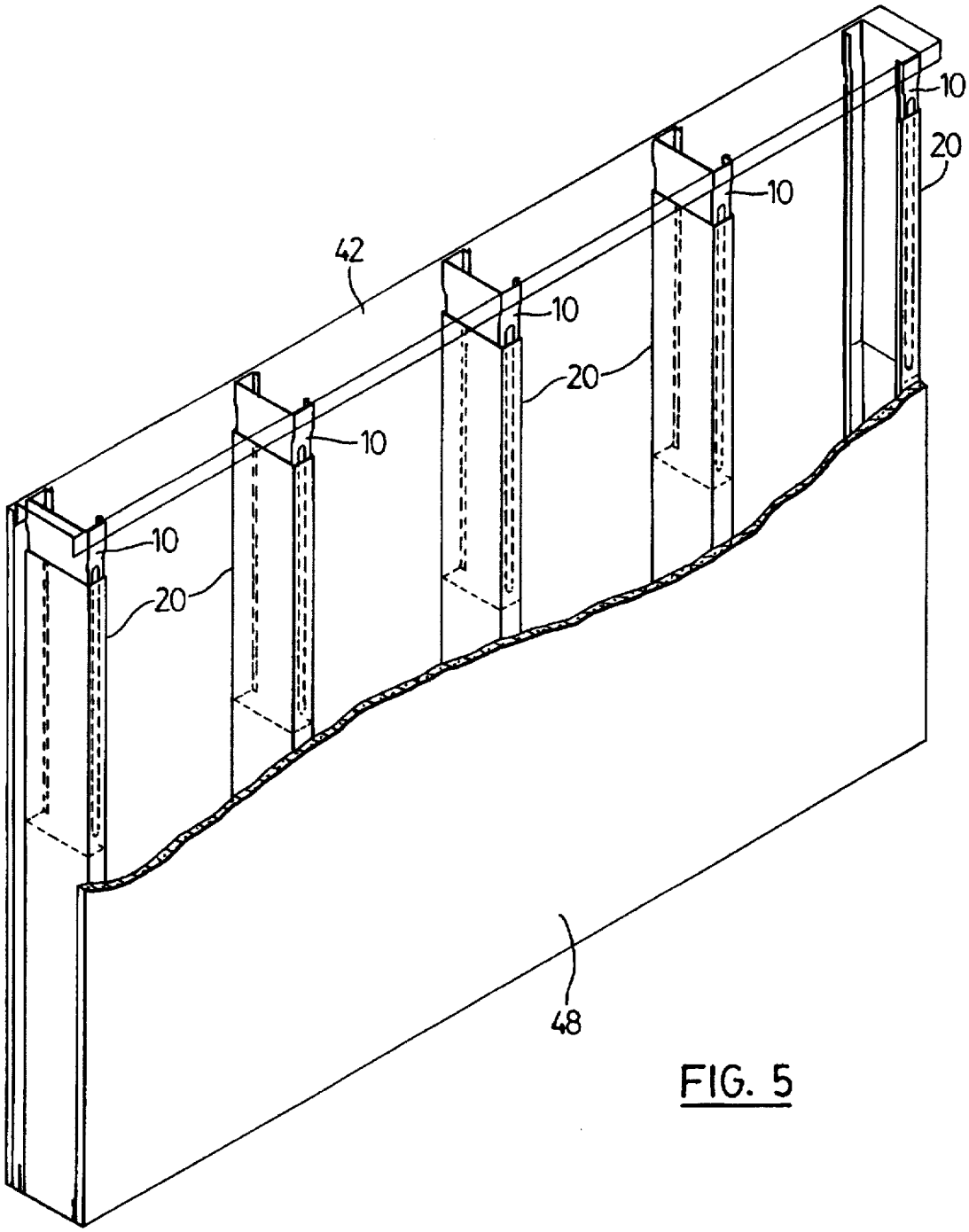
FIG. 5 is a partly broken-away perspective view of a wall section which includes several of the improved studs of the present invention.

As can be seen particularly in FIGS. 2, 3 and 5, the insert 10 is configured and sized to be snugly and slidably received within the metal stud at one end, such that the parallel lateral walls 18 and 19 lie inwardly along the side walls 28, 30 respectively, of the stud 20. The lateral walls 18, 19 are provided with recess means located so as to allow fasteners to secure a sheet of covering material to the respective side wall of the main stud without interfering with the ability of the insert 10 to move longitudinally with respect to the stud 20. More particularly, the recess means is constituted, for each lateral wall 18, 19, by a generally centrally positioned, elongate slot 34 which is disposed parallel with the edges of the respective lateral wall 18, 19. The provision of the slot 34 allows fasteners to secure a sheet of covering material to the respective side walls 28, 30 of the stud 20, without interfering with the ability of the insert to move longitudinally.

As can be seen, each of the parallel lateral walls 18, 19 has, at one end (the top end) of the insert 10, an outwardly stepped, integral end portion 40 configured such that the distance between the outer surfaces of the outwardly stepped end portions is substantially identical with the distance between the outer surfaces of the side walls 28, 30 of the metal stud 20, thus allowing the outwardly stepped end of the insert 10 to be snugly receivable within a horizontal upper track 42 of conventional nature, sized to receive either end of the metal stud. The outwardly stepped end of portion 40 also ensures that the insert 10 will not slide down into the metal stud 20 further than a position determined by the mechanical interference between the outwardly stepped end portion 40 and the end of the stud 20.

As best seen in FIGS. 1 and 2, each of the lateral walls 18, 19 of the insert 10 has, along its edge which is adjacent the integral flange 32 of the respective side wall 28, 30, a V-section insert flange 45 adapted to enclose the free edge of the integral flange 32 of the respective side wall 28, 30.

FIG. 5 illustrates a plurality of the telescoping studs 20 of the present invention, each having at the upper end an insert 10 fitted within a horizontal top track 42 (which is drawn as if substantially transparent, thus allowing a clear view of the relation between the various inserts 10 and the track 42). In FIG. 5, a sheet 48 of typical material (drywall, for example) is secured to the studs but has been broken away to reveal the connection between the inserts 10 and the track 42. A similar track 49 (see especially FIG. 2) receives the bottom ends of the studs.

While one embodiment of this invention has been illustrated in the accompanying drawings and described hereinabove, it will be evident to those skilled in the art that changes and modification may be made therein without departing from the essence of this invention, as set forth in the appended claims.

The embodiments of the invention in which an exclusive property or privilege is claimed are defined as follows:

1. For use with a metal stud of the type having a main wall with two opposed parallel edges, two similar parallel side walls extending in the same direction from said edges integral with said main wall, each side wall having, remote from the main wall, an integral flange extending toward the opposed side wall:

an insert which is configured and sized to be snugly but slidably received within said metal stud at one end thereof, and including parallel lateral walls intended to lie inwardly along said side walls of the metal stud, said lateral walls having recess means located so as to allow fasteners to secure a sheet of covering material to the respective side wall without interfering with the ability of the insert to move longitudinally with respect to the metal stud, each lateral wall further having, along its edge which is adjacent the integral flange of the respective slide wall, a V-section insert flange adapted to enclose the free edge of said integral flange of the respective side wall.

2. The insert claimed in claim 1, in which each said lateral wall is, except for said recess means, a flat elongate web of material with parallel edges, said recess means being constituted, for each lateral wall, by a generally centrally positioned, elongate slot disposed parallel with said edges of the respective lateral wall.

3. The insert claimed in claim 1, in which each of said parallel lateral walls has, at one end of the insert, an outwardly stepped end portion such that the distance between the outer surfaces of said outwardly stepped end portions is substantially identical with the distance between the outer surfaces of the side walls of said metal stud, thus allowing said one end of the insert to be snugly receivable within a horizontal upper track which is sized to receive either end of the metal stud.

4. The insert claimed in claim 2, in which each of said parallel lateral walls has, at one end of the insert, an outwardly stepped end portion such that the distance between the outer surfaces of said outwardly stepped end portions is substantially identical with the distance between the outer surfaces of the side walls of said metal stud, thus allowing said one end of the insert to be snugly receivable within a horizontal upper track which is sized to receive either end of the metal stud.

5. In Combination:

a) a metal stud of the type having: a main wall with two opposed parallel edges, and two similar parallel side walls extending in the same direction from said edges integral with said main wall, each side wall having, remote from the main wall, an integral flange extending toward the opposed side wall, and an insert snugly but slidably received within said metal stud at one end thereof, and including parallel lateral walls lying inwardly along said side walls of the metal stud, said lateral walls having recess means located so as to allow fasteners to secure a sheet of covering material to the respective side wall without interfering with the ability of the insert to move longitudinally with respect to the metal stud, each lateral wall further having, along its edge which is adjacent the integral flange of the respective side wall, a V-section insert flange adapted to enclose the free edge of said integral flange of the respective side wall.

6. The combination claimed in claim 5, in which each said lateral wall is, except for said recess means, a flat elongate web of material with parallel edges, said recess means being constituted, for each lateral wall, by a generally centrally positioned, elongate slot disposed parallel with said edges of the respective lateral wall.

7. The combination claimed in claim 5, in which each of said parallel lateral walls has, at one end of the insert, an outwardly stepped end portion which is such that the distance between the outer surfaces of said outwardly stepped end portions is substantially identical with the distance between the outer surfaces of the side walls of said metal stud, thus allowing said one end of the insert to be snugly receivable within a horizontal upper track which is sized to receive either end of the metal stud.

8. The combination claimed in claim 6, in which each of said parallel lateral walls has, at one end of the insert, an outwardly stepped end portion such that the distance between the outer surfaces of said outwardly stepped end portions is substantially identical with the distance between the outer surfaces of the side walls of said metal stud, thus allowing said one end of the insert to be snugly receivable within a horizontal upper track which is sized to receive either end of the metal stud.

* * * * *